US005189394A

United States Patent [19]

Walter et al.

[11] Patent Number: 5,189,394

[45] Date of Patent: Feb. 23, 1993

[54] FIRE ALARM DISPLAY

[75] Inventors: Ronald Walter, Bracken Ridge; Brian A. Chadwick, Beachmere, both of Australia

[73] Assignee: Grinell Asia Pacific Pty. Limited, Queensland, Australia

[21] Appl. No.: 630,079

[22] Filed: Dec. 19, 1990

[30] Foreign Application Priority Data

Dec. 22, 1989 [AU] Australia ..... PJ7984
Apr. 11, 1990 [AU] Australia ..... PJ9599

[51] Int. Cl.[5] ..... G08B 25/00
[52] U.S. Cl. ..... 340/525; 340/506; 340/286.14; 340/518; 364/146
[58] Field of Search ..... 340/525, 506, 286.13, 340/286.14, 518; 364/144, 146

[56] References Cited

U.S. PATENT DOCUMENTS 4,001,807 1/1977 Dallimonti ..... 340/525
4,558,300 12/1985 Goldman ..... 340/286.14
4,588,987 5/1986 Stephens ..... 340/525
4,933,667 6/1990 Shaw et al. ..... 340/525

*Primary Examiner*—Donnie L. Crosland
*Attorney, Agent, or Firm*—Mathews, Woodbridge & Collins

[57] ABSTRACT

A computer-based display apparatus is provided for a fire alarm system having sensors located at various positions in a building or area. The display apparatus includes a computer with associated memory and display, as well as a facility for obtaining one or more screen images of the layout of the building or area from graphical representations of the layout, such as drawings, photographs or CAD generated data. The screen images are stored in memory for display on the computer display. The display apparatus also comprises a software facility for superimposing the positions of the sensors on the displayed layouts.

9 Claims, 4 Drawing Sheets

U2
MS16450
U4
74ALS30
J41 DISABLES IRQ3 FOR
COM2 INTERRUPT
J41
DIPSHUNT
DIPSHUNT
SERIAL IN
SERIAL OUT
RS232 J43, 44, 45, 46, 47 = ON
RS485 J43, 44, 45, 46, 47 = OFF
RS422 J43, 44, 45, 46, 47 = OFF
20mALL J43, 44, 45, 46, 47 = OFF
X2
1.8432MHz
C4
47pF
C3
22pF
R2
1.5k
R3
1M
C14
0.01uf
Vcc
GND

SK103
9PIMPL8
SK102
9PINSKT
DIPSHUNT
J29
J28
J3
J1
J30
Z1
Z6
Z2
Z7
Z3
Z8
Z4
Z9
Z5
Z11
Z12
Z15
C101 1000pF
J9
J18
J11
J12
J13
J14
J15
J16
U103
MCPL-4188
U102
MCPL-4288
U105
D575176A
U106
D575176A
Vcc
VO+
VE-
DR
/DR
RD
/RE
DC
DI
DE
GND
J7
J8
J26
J17
J19
J28
J27
J21
J22
J23
U104: A
MC1489
U104: B
MC1489
U104: C
MC1489
U101: A
MC1488
U101: B
MC1488
U104: D
MC1489
U101: C
MC1488
+12
-12
SERIAL IN
J4
J5
J6
SERIAL OUT
C5
C4
C1
C2
C3
C6

FIRE ALARM DISPLAY

This invention relates to an improved fire alarm (or protection) system. In particular, the invention relates to a computer-based display system for a fire alarm system, as well as an improved interface between the fire alarm system and the computer of the display apparatus.

Fire alarm systems in large buildings normally comprise a plurality of sensors, such as heat sensors or smoke detectors, which are located at predetermined positions throughout the building. These sensors are connected to a central control panel which typically is located in a control room or security office. Conventional control or mimic panels may include a LED display comprising a series of LEDs corresponding to respective sensors. When a particular sensor is activated, for example by detecting heat or smoke in its vicinity, its corresponding LED on the control panel lights up or flashes to signal that its associated sensor is in an alarm condition.

However, an inherent and significant disadvantage of such known control panels is that the position of the activated sensor within the building is not immediately apparent from the control panel. When an alarm is signalled, it is necessary to look up the position of the activated sensor in a register or building plan which, in turn, may result in unacceptable delays in an emergency situation. To overcome this problem, some control panels display a brief message indicating the position of the activated sensor, e.g. "third floor, guest room 310". Such information however, does not give the operator an immediate indication of the position of the sensor relative to the room or floor layout, nor does it given any information regarding the position of the activated sensor relative to other sensors in its vicinity (such information providing, for example, an indication of the spread of the fire).

There are also known fire alarm control panels which are provided with a video display, such as a small CRT screen, to provide a graphic indication of the position of the activated sensor relative to its surroundings. Such displays are normally specific or dedicated to the particular building for which they are designed, and often display only basic information, e.g. only one screen may be available. The screen display is usually fixed or not easily changed, for example to add or vary positions of sensors. The cost of such a dedicated display is usually quite high, due to the need to custom design the display specifically for the building and/or fire protection system in question e.g. using a dedicated CAD (computer aided design) program.

It is an object of the present invention to provide an improved display system for a fire alarm system.

It is a further objection of the present invention to provide a display system for a fire alarm system which is relatively simple and economic to implement and of general application.

It is yet a further object of the invention to provide an improved method of displaying the output of a fire alarm system.

In one broad form, the present invention provides display apparatus suitable for use with a fire alarm system having a plurality of sensors positioned at various locations within a building or area, the display apparatus comprising input means for deriving information relating to the layout of the building or area from at least one graphic representation of the layout and for converting the information into computer readable form; computer means having a memory for storing the information relating to the layout of the building or area; superposition means for adding data relating to the locations of the sensors to the information stored in the memory of the computer means; and visual display means connected to the computer means for displaying the layout of some or all of the building or area including the positions of at least some of the sensors within the layouts.

According to another aspect of the invention there is provided a method of displaying the output of a fire protection system having a number of sensors at various locations within a building, the method comprising the steps of deriving information relating to the layout of the building from at least one graphic representation, converting the information into computer readable form, storing the information in the memory of a computer in distinguishable files each containing information relating to the layout of a particular part of the building; adding further information to the memory means relating to the positions and/or other characteristics of the sensors; and selectively displaying on a display device connected to the computer the layouts of the building together with the positions of sensors superimposed on the displayed layouts.

In the preferred embodiment, the input means comprises a screen capture facility which enables a screen image for the visual display to be captured from a variety of sources, such as a graphic display on another computer generated by a CAD program, or obtained from a drawing, building plan, photograph or other graphic representation using a scanning device. Graphic representations of various parts of the layout are captured and stored as respective screen image files in the memory of the computer means, which typically is a conventional personal computer (PC).

The superposition means comprises a software facility enabling the positions of the sensors to be superposed on the visual displays generated by each screen image file. Preferably, the data includes not only position information, but also any special details of the particular sensor and any relevant messages for emergency personnel.

A printer and/or logging printer may suitably be connected to the computer means for providing a hard copy output of the screen images, as well as a listing of logged alarms and faults.

The computer-based display apparatus of this invention enables a number of screen images to be readily obtained from existing graphic representations of the layout of the building, and further enables the positions of the sensors in the building to be subsequently added, by software, to the layouts of the screen images stored in computer memory. The hardware typically comprises a conventional PC with its associated monitor, and an interface card for enabling communication between the fire alarm system and the PC. The hardware, apart from the interface card, is readily available and is generally applicable to most fire protection systems. As the hardware is largely of conventional design, and the layouts of each particular building can be readily programmed into the computer using the abovedescribed screen capture facility, the cost of the fire alarm display system of this invention is significantly less than known dedicated displays. Furthermore, the alarm display system of this invention provides an immediate and graphic representation of the location of sensors which are in an alarm condition (or fault condition) as will be described in more detail below.

The display system of the present invention may be retrofitted to existing fire protection systems. In another form therefore, the present invention provides a fire protection system having a number of sensors at various locations within a building, a control panel or the like connected to the sensors, and a fire alarm display system as described above, wherein the output of the control panel is connected to an interface card within the computer means.

The interface card of this invention enables two way communications between the computer and the control panel of the fire alarm sensor system. The interface card converts the protocol of the data from the control panel into a format which is readable by the computer, and vice versa. Secondly, the interface card provides hardware copy protection of the software within the computer, to thereby prevent unauthorised duplication of the computer software.

In order that the invention may be more fully understood and put into practice, a preferred embodiment thereof will now be described with reference to the accompanying drawings in which.

Figure 1:
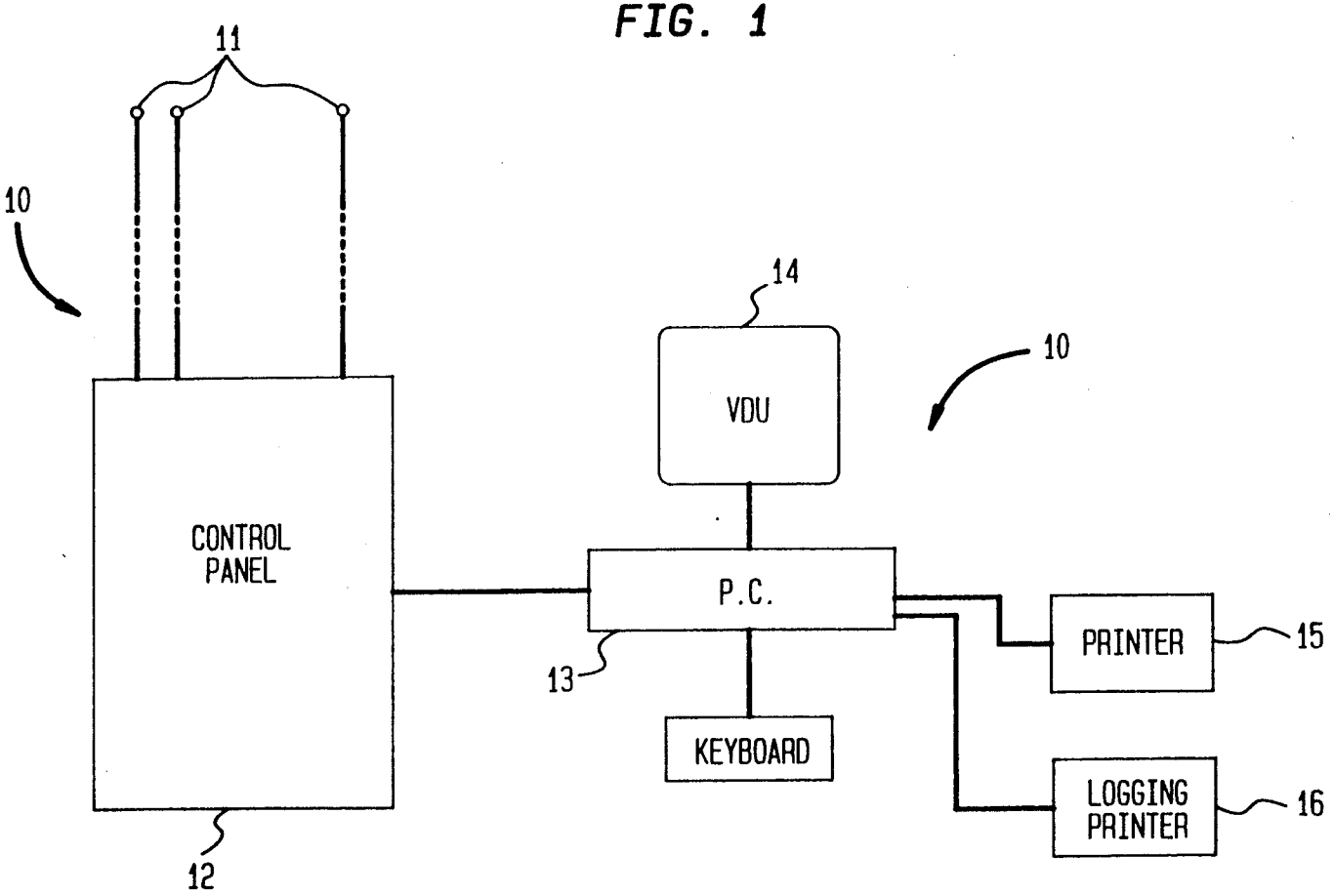
FIG. 1 is a schematic block diagram of a fire alarm system.

As shown in the drawing, the fire alarm system 10 comprises a number of sensors 11 which are connected to a control panel 12. Typically, the sensors are distributed throughout the building in which the fire alarm system is installed. For example, in a hotel, at least one sensor will be located in each room. The sensors 11 suitably are smoke detectors, heat responsive switches or other fire detection devices. The sensors 11 and control panel 12 will not be described in detail as they are conventional devices and well known in the art.

The display system of the present invention includes computer means connected to the control panel. In the illustrated embodiment, the computer means comprises a personal computer 13, which is preferably an IBM PC/AT personal computer ("PC") or an equivalent or compatible PC. The PC 13 of the preferred embodiment has 640 Kbytes RAM, a 30 Megabyte hard disk with a 1:1 interleave controller, a 1.2 megabyte floppy disk drive, EGA graphics card, a serial RS232IO port and a parallel printer port. The PC operates on DOS 3.2 operating software, or a later version. (It is particularly advantageous to use DOS 4.01 or later for the operating system, since hard disks larger than 32 megabytes may be operated as a single DOS partition thereby eliminating any possible restrictions that the 32 megabyte boundary may present with large fire protection installations.) The PC 13 has an associated video display 14 which preferably is a colour monitor. A printer 15 or logging printer 16 may be connected to the PC 13 as options.

The output of the control panel 12 is connected to a microprocessor-based interface card (described in more detail below) which is plugged into an expansion slot of the PC 13. The printer 15 is also plugged into the interface card. The interface card provides a number of functions. First, it serves to convert the protocol of the data from the control panel 12 into a format which is readable by the PC 13 and vice versa. In other words, the interface card enables communications between the control panel 12 and the PC 13, as well as the printer. Secondly, the interface card provides hardware copy protection of the software of the PC to prevent unauthorised duplication of the PC software.

Information relating to the layout of the building in which the fire protection system is installed, as well as the positions of the sensors 11 within that building, is stored in the hard disk memory of the PC 13 in software files each representing a screen image. Thus, when installing the display system, it is necessary to first load the screen image files into the PC memory. Data relating to the individual sensors is also stored in memory.

A particularly advantageous feature of the present invention is a software utility to enable the capture of screen images to be used in the display system. In prior art visual display systems for fire alarm systems, it was normally necessary to purchase a relatively expensive CAD software package to enable the building layout to be displayed on the PC video screen 14. This required a separate licence fee to be paid for each system using the CAD program.

The screen capture software of the present invention enables a screen image to be captured from a variety of sources, and stored in a disk file called a "screen image file". A copy of the source listing of the screen image capture software is attached to this specification and marked Annexure A. The software is in two parts; a first program to load the screen dump files, and a second program to save the files.

Screen images can be derived from CAD-produced screen displays. However, the display system of this invention does not require its own CAD program. Its screen capture software can be simply transferred onto a floppy disk and taken to another computer in which a CAD program is used to generate the floor layouts of the building to which the fire alarm system relates. In this manner, a single CAD program can be used to draft the layouts of all required buildings. Although the display system of this invention may utilize the end product of CAD program, it does not require its own CAD software, thereby reducing software costs.

Alternatively, the input means may comprise a scanner device to generate a screen image from a drawing, building plan, brochure, photograph or the like.

The CAD, scanner or other display program is run to display on the computer screen an image of a particular layout. The screen image capture software of this invention is then run to save a copy of the EGA graphics screen currently being displayed as a disk file (a "screen image file"). This process is repeated until all desired screen images have been saved in the computer memory. The screen image files are given individual names. (Where screen images are derived from another computer, the image files are transferred from the floppy disk to the display system PC).

If a PC having 32 megabytes of memory is being used, up to 280 screen image files can be created and stored. The files which have been saved may be viewed by using the loading program (EGALOAD) of Annexure A. This can be used to check that the screen images have been captured and saved correctly.

The PC 13 will now contain a number of screen image files which can be used to display on the PC monitor 14 the layout of a particular part of the building. For example, one screen image file may be used to display the layout of a whole floor of the building, while other screen image files may display the layouts of parts of that floor on an expanded scale. As described above, the screen image files are bit map representations, usually of floor plans, generated using CAD software, but can also be images from drawings, photographs or brochures of buildings or floor layouts etc. captured using a colour scanner or some other suitable graphic capture device. Information and data relating to the sensors are also stored, as described below.

The next step in the initialisation procedure is to load into the computer 13 information relating to the position and nature of the sensors 11 and other related data. This can be achieved by using a data loading program which superimposes the position of the sensors 11 onto the layouts represented by the screen image files. The source listing of such a program is attached to this specification as Annexure B. When this program is run, it will seek information from the operator which can be input using the keyboard and the cursor positioning keys.

Typical information which is loaded into the computer 13 includes the loop and device numbers for each sensor, the type or nature of the sensor e.g. ionization, manual station etc., and the names of the screen image files to which that sensor relates.

At a subsequent date when the system is in operation, the data loading program enables details of a new sensor to be added to the fire alarm display system. Using this program, the operator enters details of the loop number and the sensor number, followed by details of the sensor type. The program will confirm the sensor type selected and then ask for the screen image file name for the first screen image for this sensor. The screen image will then be displayed to enable the operator to use the cursor positioning keys on the keyboard to position the device at the appropriate position on the layout displayed on the screen.

To assist in adding new sensors, the devices that have already been assigned to this particular screen file are shown in green while the newly added sensor to be positioned on the screen is shown in red. When the sensor has been correctly positioned, the ENTER key is pressed, and the program will request the file name for the next screen image file, the process then being repeated for up to ten screen image files. After the sensor has been positioned on all desired screen images, the operator may add information relating to this sensor. This information is displayed when the sensor is in an alarm condition.

The data loading program also enables sensors to be removed from the display system, to list all sensors recorded in the system, and to show the location of a selected sensor.

The operator also has the option of specifying whether the sensor is to be displayed on the screen when inactive. Thus, some sensors may be displayed only when active or in a fault condition, while others may be displayed continuously. Furthermore, whether or not a sensor is to be displayed when inactive is selectable for each screen image file, i.e. for each level of zoom. Thus, to avoid overcrowding on the screen, it may be advisable not to show all inactive sensors on a screen image of the whole floor layout of a large installation, yet inactive sensors can still be displayed in an expanded screen image of a portion of the layout surrounding the activated sensor.

The related data which is loaded for each sensor can be used to produce screen messages when that sensor is actuated. For example, the screen messages may advise fire personnel to bring breathing apparatus if that sensor is positioned at a location where toxic fumes are likely to be present, or advise of other specific actions to be taken in response to a particular sensor alarm, thereby increasing safety to emergency personnel as well as building occupants.

The computer 13 and its associated software can be used to monitor alarms and faults as detected by the control panel 12. It provides two separate disk-based log files, one for alarm details, and the other for fault details, which may be enabled, disabled and cleared as desired. These log files are continually appended until they are manually cleared, and therefore provide extensive historical information about the sensors 11 connected to the control panel 12.

When an alarm or fault occurs in a particular sensor, the fire alarm system of this embodiment displays the first screen image file for the activated sensor. Complete details of the device in alarm (or fault) are graphically displayed, preferably in high resolution colour, allowing emergency personnel to immediately identify the location of the fire. The operator also has the option of zooming in on the location of the actuated sensor (in alarm or fault) by displaying screen image files of the area proximate to the sensor, or the operator may look at details of other sensors currently in alarm and/or fault. Alarm detection overrides fault rectification. That is, if only faults have occurred up to a particular time, the detection of an alarm condition in a sensor will override whatever is currently being done on the screen at that time.

If an optional touch screen is being used, options may be selected on the touch screen instead of the keyboard function keys. That is, control is effected by merely touching the screen to "zoom in", "zoom out", etc.

The computer-based fire protection system of the preferred embodiment has capacity for 190 alarms and 190 faults being concurrently active. Once this limit is exceeded, the system will discard additional incoming alarm and fault details, although these details will still be logged to disk if fault and/or alarm logging is enabled. However, it will be apparent to those skilled in the art, that the capacity of the system can be increased by increasing the capacity of the computer.

A colour monitor 14 is used in the preferred embodiment. Inactive sensors (i.e. not in an alarm or fault condition) can be displayed in green, and sensors in an alarm condition can be displayed in red, while sensors currently in fault are shown in yellow on the screen. If an alarm and/or fault has not been acknowledged at the control panel, then the symbol for the active device is preferably shown with a flashing attribute to attract attention. After acknowledgement, active devices are shown as solid red for a alarms, or solid yellow for faults.

The active sensor whose details are currently being displayed on the screen is shown encircled by a flashing red ring for easy identification. If there are no recorded details or information for the active device, then an icon representing the fire indicator panel itself is shown. Faults in the fire indicator panel module are also handled in this manner.

The device details of any active sensor will be shown in an information box at the bottom left of the screen. An information box at the bottom right of the screen displays the current number of alarms and faults detected, and any custom message for the sensor as sent from the control panel.

When the alarm display system is in this display mode, the operator may select the required action by use of the keyboard function keys or, if a touch screen is being used, the operator may select desired actions by simply touching the monitor screen surface at the location of the desired option shown on the monitor screen. For example, the operator may select a display of the next screen for the current active sensor, or the previous screen. The operator may select to display the next sensor in alarm or fault condition. The display system will change from this display mode and return to a monitor mode when a reset condition is detected from the control panel. However, if alarms or faults have been detected, it is not possible to return to the monitor mode until all alarms and faults have been acknowledged at the control panel, and the panel is then finally reset.

Figure 2:
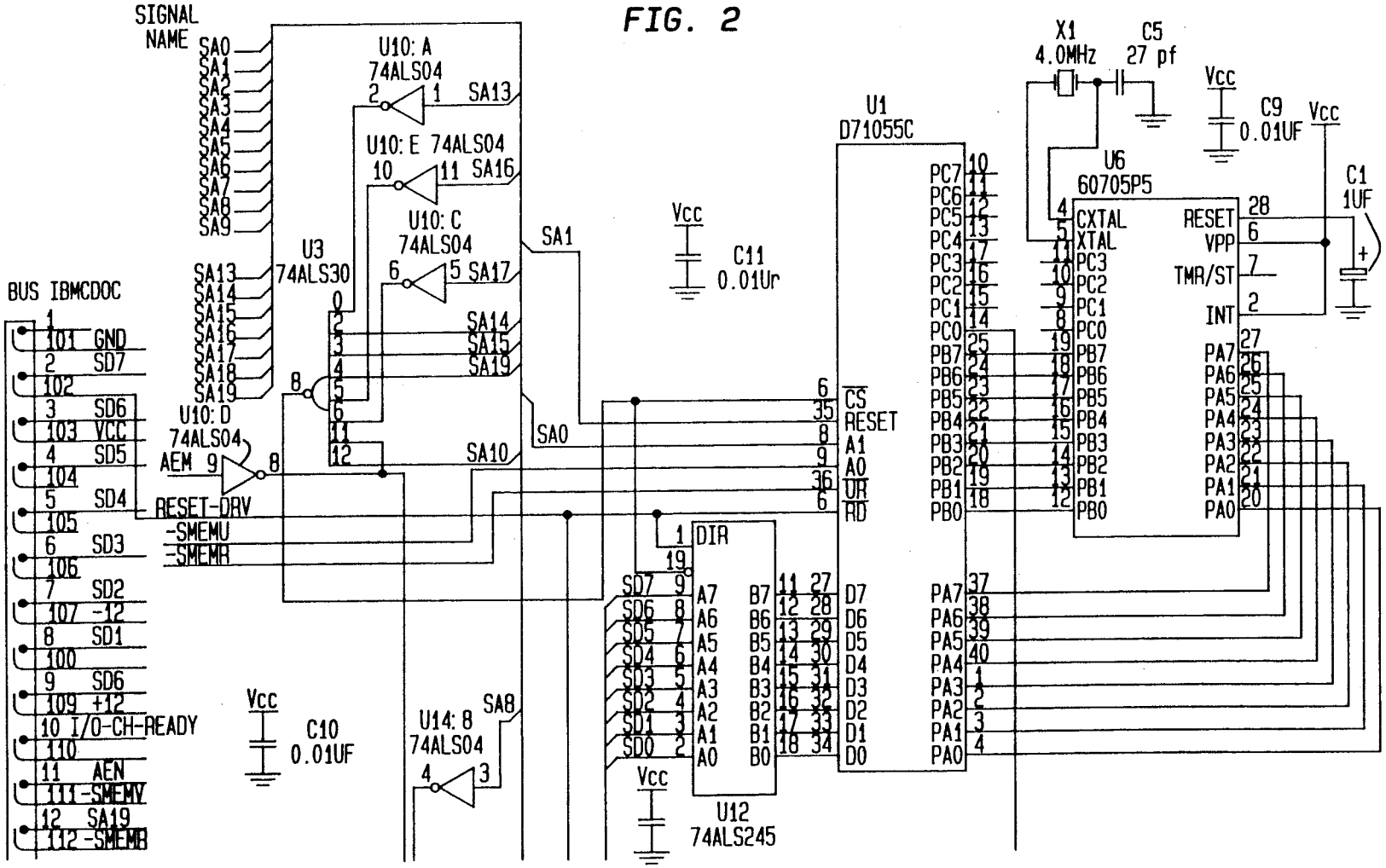
FIG. 2 is an electrical circuit diagram of the interface card.
Figure 2:
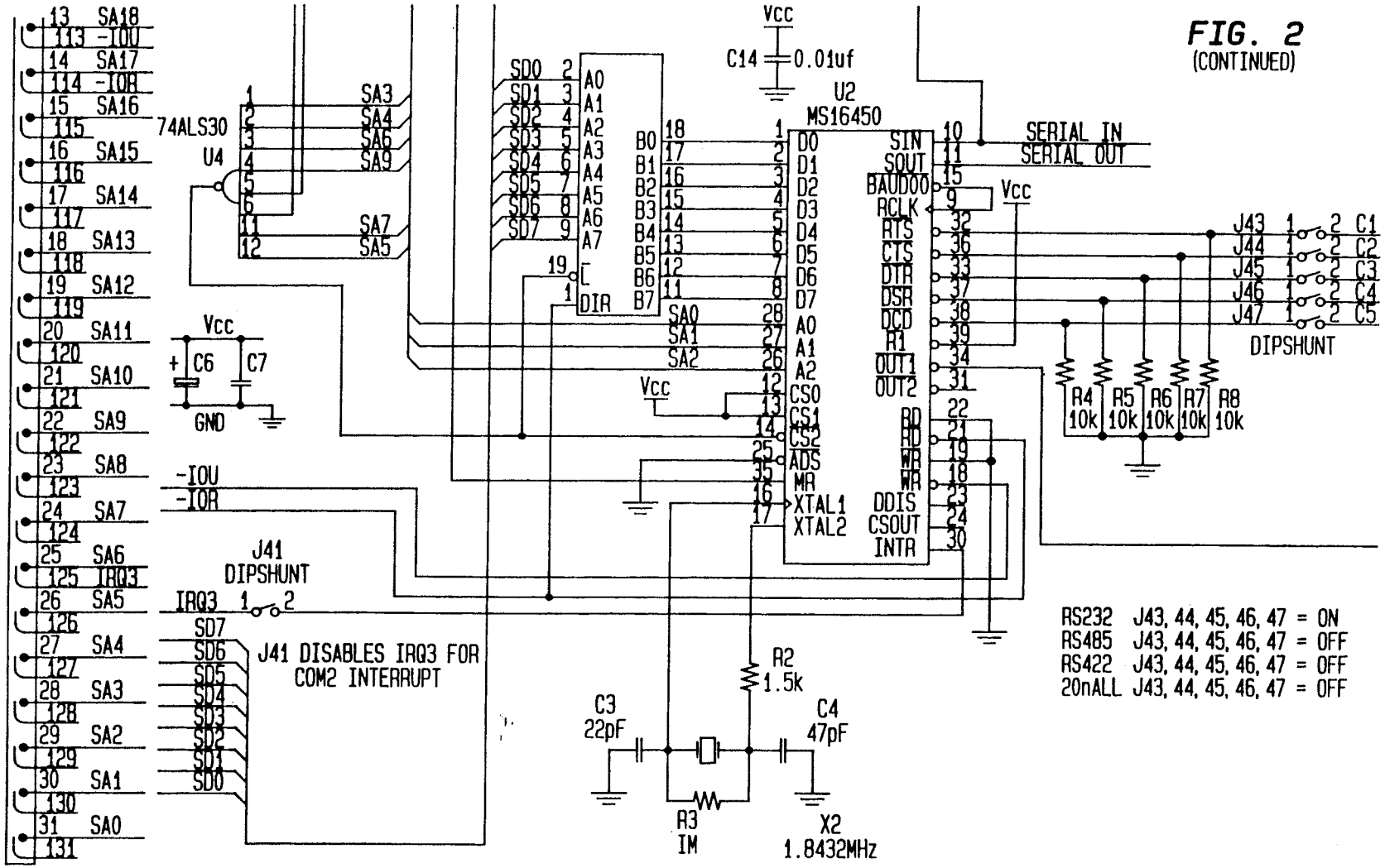
Figure 2:
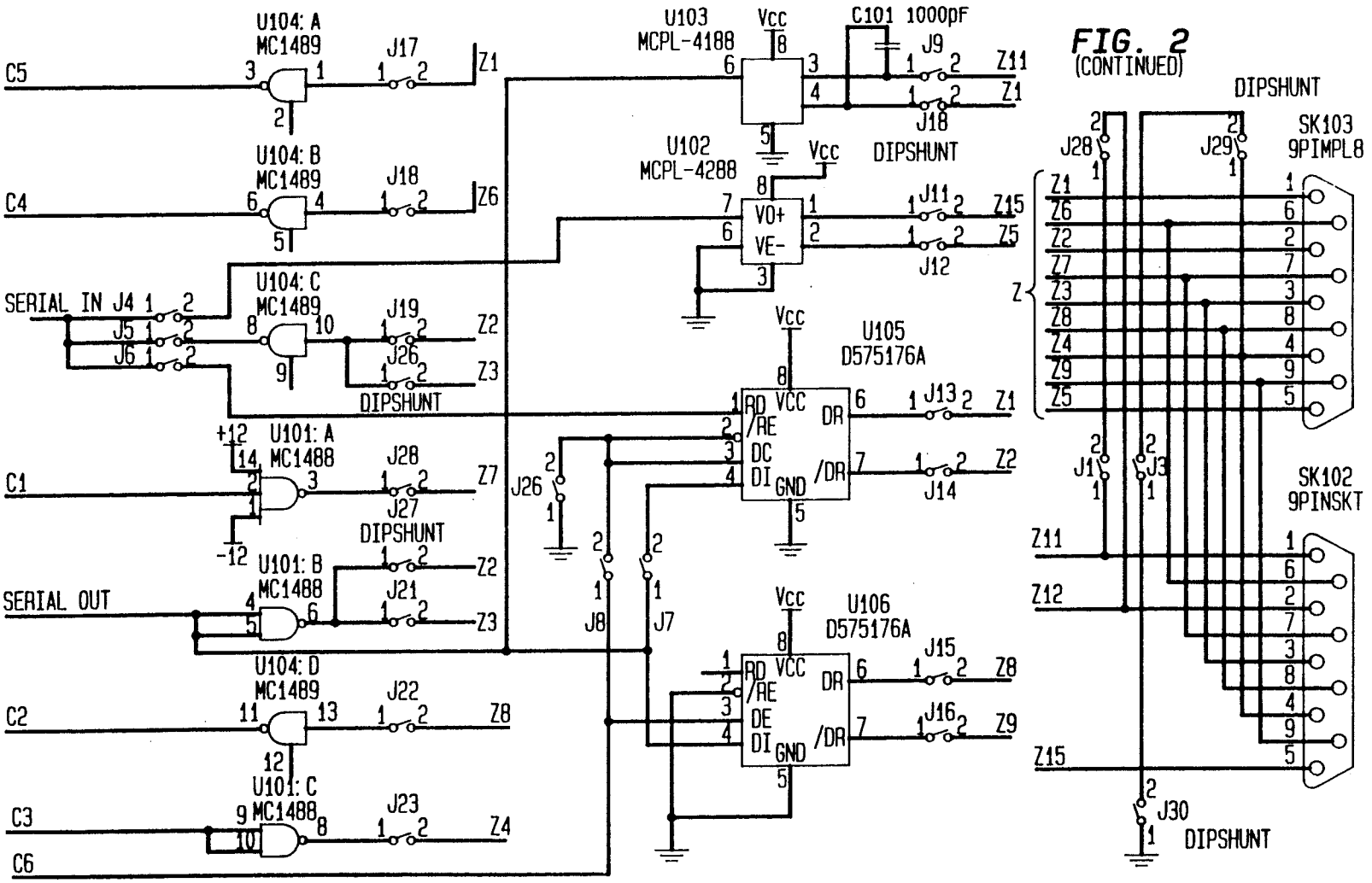

FIG. 2 is a circuit diagram of a plug-in card used to provide an interface between the PC 13 and control panel 12. The illustrated card is an XL Graphics Interface card which is designed to plug into an 8 bit bus expansion slot of an IBM PC-AT personal computer or equivalent personal computer, and is a half length card.

The interface card performs two primary functions, namely full duplex 20 mA current loop communications with the hot fire protection (control) panel, and a hardware copy protection mechanism to prevent software theft.

The current loop communications is achieved by mapping a National Semiconductor N S16450 Serial Communications Adaptor in the IBM PC-AT 1/O address space reserved for the second communications port (COM2) of the computer. The serial input and output from the NS16450 are converted to 20 mA current loop by Hewlett Packard HCPL4200 and HCPL4100 optically coupled converters respectively, as shown in FIG. 2.

The use of current loop communications enables data to be transmitted over long distances between the control panel and the computer, typically up to 1.5 kilometers. This allows the computer and associated peripheral equipment to be located in a different building from that in which the control panel is housed.

The copy protection mechanism uses a Motorola 68705P5 microcomputer running suitable protection scheme software, with two of its ports being addressable through an Intel D71055C parallel peripheral interface mapped in the IBM PC-AT memory address space, as shown in FIG. 2.

The computer-based display system of this invention has several advantages over prior art systems, including:

(a) The layout of the particular building in which the fire alarm system is installed can be simply and economically loaded into the screen image files. Only one CAD or scanning program is required to initialise a multiplicity of display systems. Alternatively, the screen image files can be derived from existing drawings, photographs and the like by using a known scanning device.

(b) The positions of the sensors are easily loaded into the system and are clearly displayed on the screen layouts. As the system is software-based, additional sensors can be added to the screens, or removed, or changed in position simply by keyboard instructions.

(c) The display system hardware is of universal application, and is interchangeable between fire protection systems in different buildings for example.

(d) The display system uses a conventional PC which is readily available and relatively inexpensive.

(e) The position of a sensor in alarm or fault condition is immediately ascertained upon viewing the screen. Furthermore, particular information relating to that sensor is immediately available to the operator.

(f) The computer-based display system can be retrofitted to existing fire alarm systems which have a suitable data output port with minimum modification.

(g) The computer-based display system is field programmable to allow easy economical on site modification for all building alterations. Password protection is preferably provided for security.

The foregoing describes only one embodiment of the invention, and modifications which are obvious to those skilled in the art may be made thereto without departing from the scope of the invention as defined in the following claims.

DB087207527
CULLEN-005

ANNEXURE A

EGALODE.COM

```
  EGALode - Include file used to load an 'EGASaved' screen dump


function egalode(infilename : fnametype; state : boolean;
          show_all_devices : boolean ) : boolean;

type
  bit_plane_type = array[1..11200] of word;

var
  bit_plane_number : integer;
  bit_plane : bit_plane_type absolute $a000:$0000;
  drver : integer;
```

```
    drver_mode : integer;
    infile : file of bit_plane_type;
    devfile : file of device_record_type;
    in_device : device_record_type;
    old_color : word;
    scr_num : integer;

  begin
    if state then begin
      egalode := false;
      assign(infile,infilename);
      {$I-} reset(infile) {$I+};
      if IOResult <> 0 then begin
        ClearDevice;
        outtextxy(100,100,'The Screen Dump File (' + infilename
       + ') could not be located...');
        delay(2000);
      end
      else begin
        bit_plane_number := 1;
        repeat
       Port[$3c4] := 2;
       Port[$3c5] := bit_plane_number;
       read(infile,bit_plane);
       bit_plane_number := bit_plane_number * 2;
        until bit_plane_number = 16;
        Port[$3c4] := 2;
        Port[$3c5] := 15;
        close(infile);
        assign(devfile,'alarmdev');
        {$I-} reset(devfile); {$I+}
        If IOResult <> 0 then begin
       ClearDevice;
       outtextxy(100,100,'The Alarm Device File (alarmdev) '
         + ') could not be located...');
       delay(2000);
        end
        else begin
       while (not eof(devfile)) do begin
         read(devfile,in_device);
         if (in_device.loop_number <> 'XX') then
           for scr_num := 1 to MAX_SCREENS do
         if (('screens\' + in_device.screens[scr_num].name )
             = infilename) then
        if ( show_all_devices or
                in_device.screens[scr_num].display ) then
             display_sensor(in_device.device_type,
                         in_device.screens[scr_num].x,
                         in_device.screens[scr_num].y, Green);
   end; { of while }
   close(devfile);
    end;
    egalode := true;
  end
end
else begin                { **** ver 4.2 mod *** }
  egalode := false;
  assign(infile,infilename);
  {$I-} reset(infile) {$I+};
  if IOResult <> 0 then begin
    gettextsettings(old_text_info);
    SetUserCharSize(1,2,1,2);          { MultX,DivX,MultY,DivY }
    SetTextJustify(LeftText,CenterText);        { Horiz,Vert }
    SetTextStyle(DefaultFont,HorizDir,UserCharSize); { Font,Dir,CharSize
    old_color := GetColor;
    SetColor(Black);
```

```
      outtextxy(50,120,'The Banner Dump File (' + infilename
     + ') could not be located...');
      SetColor(Red);
      outtextxy(50,120,'The Banner Dump File (' + infilename
     + ') could not be located...');
      settextjustify(old_text_info.horiz,old_text_info.vert);
      settextstyle(old_text_info.font,old_text_info.direction,
     old_text_info.charsize);
    end
    else begin
      bit_plane_number := 1;
      repeat
     Port[$3c4] := 2;
     Port[$3c5] := bit_plane_number;
     read(infile,bit_plane);
     bit_plane_number := bit_plane_number * 2;
      until bit_plane_number = 16;
      Port[$3c4] := 2;
      Port[$3c5] := 15;
      close(infile);
    end;
    egalode := true;
  end;
end;
```

EGALOAD.PAS

```
{ EGALoad - Loads screen dump files which have been 'EGASaved' to
        check that they're ok    ver 5.0 }
{$V-,N-}
program egaload;
uses
  Graph,Crt;
   type
     fnametype = string[63];

   var
     infilename : fnametype;
     ch : char;
     drver : integer;
     drver_mode : integer;
     state      : boolean;
     inchar     : char;


   {$I egald.inc}
     procedure egavgadriver; external;
   {$L egavga.obj}
   begin
       if RegisterBGIdriver(@egavgadriver) < 0 then
       begin
         writeln ( 'Fatal ERROR registering graphics driver: ',
             GraphErrorMsg(GraphResult) );
         halt ( 1 );
       end;

     writeln;
     state := false;
     writeln;
     writeln;
   writeln('EGALoad Version 5.0 - Loads screen dump files "EGASaved"');
     writeln;
     write('Screen Dump File Name ( <cr> to abort....) - ');
     readln(infilename);
     if infilename = '' then halt ;
```

```
    { First we set the EGA into 640x350 graphics mode }

    drver := 3;  { EGA }
    drver_mode := 1; { 640 x 350 pixels, 16 colours }
    InitGraph(drver,drver_mode,'');

    if egalode(infilename) then begin
      repeat until keypressed;
      ch := readkey;
      CloseGraph;
    end
    else CloseGraph;

  end.
```

EGASAVE.PAS

```
  { EGASave - This Terminate and Stay Resident Routine is used to
              capture the current image on an EGA screen which is
              in the 640 x 350 pixel colour graphics mode.  It
              will capture the 4 colour planes at location A000
              for a distance of 22,400 bytes (or 280 rows)
                ver 5.0 }

  {$S-,I-,R-,N-}
{$M 1024,0,200}
program EGASave;

uses
  Dos,TpInt,TpTsr,Crt;     { Units from Turbo Professional }

const
  HotKey = $080F;      { Use Alt-Tab to pop-up }
  WaitForDos = True;   { Don't pop-up unless we're sure it's ok }

type
  bit_plane_type = array[1..11200] of word;

var
  outfile     : file of bit_plane_type;
  bit_plane        : bit_plane_type absolute $a000:$0000;
  bit_plane_number : integer;
  char1       : char;
  char2       : char;
  foundfile        : boolean;
  badfile     : boolean;

{$F+}
procedure PopupEntryPoint(var Regs : Registers);
begin
  char1 := 'A';
  char2 := chr(ord('A') - 1);     { Start pointing one before AA }
  foundfile := false;
  badfile := false;
  repeat
    char2 := chr(ord(char2) + 1);
    if char2 > 'Z' then begin
      char2 := 'A';
      char1 := chr(ord(char1) + 1);
    end;
    if (char1 <= 'Z') then begin
      assign(outfile,'s' + char1 + char2);
      {$I-} reset(outfile); {$I+}
      if IOResult <> 0 then
     foundfile := true
      else
     close(outfile);
    end
```

```
  else badfile := true;
until ((foundfile) or (badfile));
assign(outfile,'s' + char1 + char2);
{$I-} rewrite(outfile); {$I+}
if IOResult = 0 then begin
  for bit_plane_number := 0 to 3 do begin  { Must save all 4 bit-planes }
    Port[$3ce] := 4;
    Port[$3cf] := bit_plane_number;
    write(outfile,bit_plane);
  end;
  Port[$3ce] := 4;
    Port[$3cf] := 0;
    close(outfile);
  end;
end;
{$F-}

{ Main-line of the Program.  We set up the interrupts then go resident }

begin
  if DefinePop(HotKey,@PopupEntryPoint,Ptr(SSeg,SPtr),WaitForDos)
      then begin
    writeln;
    writeln('EGASave Version 5.0 Loaded...press <Alt><Tab> to activate.');
    writeln;
    PopupsOn;
    if not TerminateAndStayResident(ParagraphsToKeep,0) then {};
  end;
  writeln('Sorry, EGASave was unable to go resident.');
end.


procedure display_event_sensors; { Displays all sensors in the array for th
                        current_event floorplan, highlight the
                        current event and show its details }
var
  cntr : integer;
  cfilename : string[35];
  ccolor : word;
  scr_num : integer;

begin
  show_device_info(event_loop[current_event],event_device[current_event],
    type_in_words(event_d_type[current_event]),event_r_act_1[current_event]
    event_r_act_2[current_event], event_custom[current_event], current_even
  cfilename := event_screens[current_event,current_screen].name;
  for cntr := 1 to tot_events do
  begin
    if (event_type[cntr] = 'A') then ccolor := Red else ccolor := Yellow;
    for scr_num := 1 to MAX_SCREENS do
      if ( (event_screens[cntr,scr_num].name = cfilename) ) then
        (* device is on current screen so display it *)
     display_sensor(event_d_type[cntr],
                  event_screens[cntr,scr_num].x,
                  event_screens[cntr,scr_num].y,  ccolor);
  end;
  SetFillStyle(SolidFill,Black);
(*  Bar(1,280,640,290);*)
end;


function Sensor_image_memory_pointer(var mem_size : word) : pointer;

var
  P : pointer;
```

```
begin
  mem_size := imagesize(0,0,30,24);
  getmem(P, mem_size);
  sensor_image_memory_pointer := P;
end;

function Get_Screen_Pos(infilename : fnamesize;
                device_type : char; var xpos, ypos : integer)
  : boolean;

var
  ch       : keyboard_code;
  drver       : integer;
  drver_mode : integer;
  P        : pointer;
  mem_size    : word;

begin
  Get_Screen_Pos := false;

  { First we set the EGA into 640x350 graphics mode }

  drver := 3;  { EGA }
  drver_mode := 1; { 640 x 350 pixels, 16 colours }
  InitGraph(drver,drver_mode,'');
  state := true;
  if egalode('screens\' + infilename,state, TRUE ) then begin
  if ( xpos < 11 ) or ( xpos > 619 ) then xpos := 240;
  if ( ypos < 14 ) or ( ypos > 260 ) then ypos := 63;
    bar_menu('A');

    P := sensor_image_memory_pointer(mem_size);
    getimage((xpos - 10),(ypos - 12),
          (xpos + 20),(ypos + 12),P^);
    display_sensor(device_type,xpos,ypos,red);
    repeat
      repeat until keypressed;
      get_key ( ch );
      putimage((xpos - 10),(ypos - 12)
     ,P^,normalput);
      if ( ch.flags = 0 ) then
      begin    (* unshifted key has been pressed *)
     case ord(ch.scan_code) of
       72: begin   { up }
          if ypos > 14 then ypos := ypos - 1;
           end;
       80: begin   { down }
          if ypos < 260 then ypos := ypos + 1;
           end;
       75: begin   { left }
          if xpos > 11 then xpos := xpos - 1;
           end;
       77: begin   { right }
          if xpos < 619 then xpos := xpos + 1;
           end;
       else begin
           end;
     end;
      end { of if a cursor key }
      else
      begin   (* shift key has been pressed *)
     case ord ( ch.ascii ) of
       56: begin   { up }
          if ( ypos < 20 ) then
           ypos := 14
         else
          ypos := ypos - 7;
          end;
```

```
        50: begin   { down }
           if ypos > 253 then
             ypos := 260
           else
             ypos := ypos + 7;
            end;
        52: begin   { left }
           if xpos < 19 then
             xpos := 11
           else
             xpos := xpos - 8;
            end;
        54: begin   { right }
           if xpos > 611 then
             xpos := 619
           else
             xpos := xpos + 8;
            end;
        else begin
             end;
      end;
       end;
       getimage((xpos - 10),(ypos - 12),
           (xpos + 20),(ypos + 12),P^);
       display_sensor(device_type,xpos,ypos,red);
     until ord(ch.ascii) = 13;
     freemem(p,mem_size);

     { Now we must set the Screen Mode back to Text }

     CloseGraph;
     Get_Screen_Pos := true;
   end { of if not error }
   else CloseGraph; { if an error has occurred in loading the screen }
 ? ';
```

ANNEXURE B

CULLEN-005

```
{  Display sensors

 ==========================================================================
procedure Display_Sensor(device_type : char; xpos,ypos: integer
                  ; ccolor : word);
var
  ccolor1  : word;

begin
  ccolor1 := getcolor;
  setcolor(ccolor);
  SetFillStyle(SolidFill,Black);
  case device_type of
      '2' : begin     { Pressure Sensor }
           bar((xpos - 5),(ypos - 5)
                 ,(xpos+ 12),(ypos + 5));
           rectangle((xpos - 5),(ypos - 5)
                      ,(xpos + 12),(ypos+ 5));
           OutTextXY((xpos - 3),(ypos- 3), 'PS');
            end;
      '3': begin      { Flow Switch }
          bar((xpos - 5),(ypos - 5)
                ,(xpos+ 12),(ypos + 5));
          rectangle((xpos - 5),(ypos - 5)
                      ,(xpos + 12),(ypos+ 5));
```

```
    OutTextXY((xpos - 3),(ypos- 3), 'FS');
     end;
'4': begin      { Valve Monitor Switch }
    bar((xpos - 5),(ypos - 5)
          ,(xpos+ 14),(ypos + 5));
    rectangle((xpos - 5),(ypos - 5)
            ,(xpos + 14),(ypos+ 5));
    OutTextXY((xpos - 3),(ypos- 3), 'VM');
     end;
'I': begin      { Ion Detector }
    bar((xpos - 7),(ypos - 6)
          ,(xpos+ 20),(ypos + 6));
    circle(xpos,ypos,7);
    OutTextXY((xpos - 3),(ypos- 3), 'S I');
     end;
'M': begin      { Manual Station }
    bar((xpos - 7),(ypos - 6)
          ,(xpos+ 7),(ypos + 6));
    rectangle((xpos - 7),(ypos - 6)
                ,(xpos + 7),(ypos+ 6));
    circle(xpos,ypos,7);
     end;
'P': begin      { Photo Detector }
    bar((xpos - 7),(ypos - 6)
           ,(xpos+ 20),(ypos + 6));
    circle(xpos,ypos,7);
    OutTextXY((xpos - 3),(ypos- 3), 'S P');
     end;
'R': begin      { Roof Smoke Detector }
    bar((xpos - 10),(ypos - 8)
          ,(xpos+ 20),(ypos + 8));
    circle(xpos,ypos,7);
    circle(xpos,ypos,10);
    OutTextXY((xpos - 3),(ypos- 3), 'S R');
     end;
'T': begin      { Thermal Detector }
    bar((xpos - 8),(ypos - 6)
          ,(xpos+ 20),(ypos + 6));
    circle(xpos,ypos,8);
    line(xpos,(ypos + 6)
          ,xpos,(ypos - 6));
    line((xpos + 1),(ypos + 6)
          ,(xpos + 1),(ypos - 6));
    line((xpos + 2),(ypos + 5)
          ,(xpos + 2),(ypos - 5));
    line((xpos + 3),(ypos + 5)
          ,(xpos + 3),(ypos - 5));
    line((xpos + 4),(ypos + 4)
          ,(xpos + 4),(ypos - 4));
    line((xpos + 5),(ypos + 4)
          ,(xpos + 5),(ypos - 4));
    line((xpos + 6),(ypos + 3)
          ,(xpos + 6),(ypos - 3));
    line((xpos + 7),(ypos + 2)
          ,(xpos + 7),(ypos - 2));
    OutTextXY((xpos - 3),(ypos- 3), '  T');
     end;
'U': begin      { Under-Floor Smoke Detector }
    bar((xpos - 10),(ypos - 8)
          ,(xpos+ 20),(ypos + 8));
    circle(xpos,ypos,7);
    circle(xpos,ypos,10);
    OutTextXY((xpos - 3),(ypos- 3), 'S U');
     end;
'V': begin      { Air Duct Detector }
    bar((xpos - 10),(ypos - 8)
          ,(xpos+ 14),(ypos + 8));
    circle(xpos,ypos,7);
```

```
          arc(xpos,ypos,90,270,10);
          line(xpos,(ypos - 7)
                 ,(xpos + 12),(ypos - 7));
          line(xpos,(ypos + 7)
                 ,(xpos + 12),(ypos + 7));
          OutTextXY((xpos - 3),(ypos- 3), 'S');
           end;
      '?': begin      { Device Not on File }
          bar((xpos - 10),(ypos - 5)
                ,(xpos+ 16),(ypos + 5));
          rectangle((xpos - 10),(ypos - 5)
                      ,(xpos + 16),(ypos+ 5));
          OutTextXY((xpos - 8),(ypos- 3), 'FIP');
{          bar((xpos - 5),(ypos - 5)
                ,(xpos+ 12),(ypos + 5));
          rectangle((xpos - 5),(ypos - 5)
                      ,(xpos + 12),(ypos+ 5));
          OutTextXY((xpos - 3),(ypos- 3), 'FIP');}
           end;
      else  OutTextXY((xpos - 3),(ypos- 3), '?');
  end; { of case }
  setcolor(ccolor1);
end;
```

EGALD.INC

```
{
{ EGALd - Include file used to load an 'EGASaved' screen dump
         file  ver 5.0 }

function egalode(infilename : fnametype) : boolean;

type
  bit_plane_type = array[1..11200] of word;

var
  bit_plane_number : integer;
  bit_plane : bit_plane_type absolute $a000:$0000;
  drver : integer;
  drver_mode : integer;
  infile : file of bit_plane_type;

begin
  egalode := false;
  assign(infile,infilename);
  {$I-} reset(infile) {$I+};
  if IOResult <> 0 then begin
    ClearDevice;
    outtextxy(100,100,'The Screen Dump File (' + infilename
      + ') could not be located...');
    delay(2000);
  end
     else begin
       bit_plane_number := 1;
       repeat
         Port[$3c4] := 2;
         Port[$3c5] := bit_plane_number;
         read(infile,bit_plane);
         bit_plane_number := bit_plane_number * 2;
       until bit_plane_number = 16;
       Port[$3c4] := 2;
       Port[$3c5] := 15;
       close(infile);
       egalode := true;
     end
   end;
```

We claim:

1. Display apparatus suitable for use with a fire alarm system having a plurality of sensors positioned at various locations within an area layout, the display apparatus comprising:

(i) computer means for storing information relating to said area layout, said computer means having a memory;

(ii) input means for deriving said information relating to said area layout from at least one pre-existing documentary graphic representation of said area layout, said input means storing in said memory said information as at least one screen image, said input means including a scanning device for scanning said documentary graphic representation and providing an output thereof in digital form to said memory;

(iii) superposition means for adding data relating to said locations of said sensors to said at least one screen image stored in said memory; and (iv) visual display means connected to said computer means for selectively displaying said superpositioned stored screen image so as to display said layout including said locations of said sensors.

2. Display apparatus as claimed in claim 1, wherein said area layout comprises a building layout.

3. Display apparatus as claimed in claim 1, wherein said superposition means comprises a software facility for superposing said positions of said sensors on said screen image stored in said computer memory.

4. Display apparatus as claimed in claim 3, wherein said superposition means includes a facility for recording related information of said sensors, such that if a sensor is activated, the recorded related information of the activated sensor is displayed on said visual display means when said screen image including said activated sensor is displayed.

5. Display apparatus as claimed in claim 1, wherein said sensors are connected to control means, and wherein said display apparatus further comprises an interface circuit connected between said control means and said computer for providing protocol conversion of date communication between said control means and said computer.

6. Display apparatus as claimed in claim 5, wherein said interface circuit includes hardware means for preventing unauthorized copying of software.

7. A method of displaying information relating to an area layout of a fire protection system having a number of sensors at various locations within a building, the method comprising the steps of:

deriving first information relating to said area layout of the building from at least one pre-existing documentary graphic representation;

converting said first information into digital form;

storing said first information in the memory of a computer in distinguishable files wherein each of said files contains information relating to said layout of the building;

adding second information relating to characteristics of said sensors to said first information stored in the memory of said computer; and selectively displaying on a display device connected to said computer said first and second information so that positions of sensors are superimposed on the displayed layout of said building.

8. The method as claimed in claim 7 wherein said characteristics of said sensors comprise positions of said sensors.

9. A fire alarm system comprising:

(i) a plurality of sensors adapted to be deployed at selected locations in an area layout;

(ii) control means for monitoring conditions of said sensors connected to said sensors;

(iii) computer means for storing information relating to said area layout having a memory and a visual display;

(iv) an interface circuit connected between said control means and said computer means;

(v) input means for deriving information relating to said area layout from a pre-existing documentary graphical representation of said layout and storing said information in said memory; and (vi) means for storing the position of said sensors in said memory such that upon display of said stored layout on a visual display said stored positions of said sensors are thereon.

* * * * *